US009908347B2

(12) United States Patent
Sodeyama

(10) Patent No.: US 9,908,347 B2
(45) Date of Patent: Mar. 6, 2018

(54) TAPE CARTRIDGE AND TAPE PRINTER

(71) Applicant: Seiko Epson Corporation, Tokyo (JP)

(72) Inventor: Hideo Sodeyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 15/087,969

(22) Filed: Mar. 31, 2016

(65) Prior Publication Data

US 2016/0214417 A1 Jul. 28, 2016

Related U.S. Application Data

(63) Continuation of application No. 14/593,476, filed on Jan. 9, 2015, now Pat. No. 9,327,532, which is a continuation of application No. 13/808,800, filed as application No. PCT/JP2011/003908 on Jul. 7, 2011, now Pat. No. 8,974,132.

(30) Foreign Application Priority Data

Jul. 16, 2010 (JP) ..... 2010-161840

(51) Int. Cl.

| | |
|---|---|
| ***B41J 15/04*** | (2006.01) |
| ***B41J 3/36*** | (2006.01) |
| ***B41J 3/407*** | (2006.01) |
| ***B41J 2/325*** | (2006.01) |

(52) U.S. Cl.

CPC ..... *B41J 15/044* (2013.01); *B41J 2/325* (2013.01); *B41J 3/36* (2013.01); *B41J 3/4075* (2013.01)

(58) Field of Classification Search

CPC ..... B41J 15/044; B41J 3/4075

See application file for complete search history.

(56) References Cited

U.S. PATENT DOCUMENTS

| | | | |
|---|---|---|---|
| 5,022,771 | A | 6/1991 | Paque |
| 5,193,919 | A | 3/1993 | Godo et al. |
| 5,295,753 | A | 3/1994 | Godo et al. |
| 5,492,420 | A | 2/1996 | Nunokavva et al. |
| 5,518,328 | A | 5/1996 | Okuchi et al. |

(Continued)

FOREIGN PATENT DOCUMENTS

| | | |
|---|---|---|
| EP | 0635375 | 1/1995 |
| EP | 0696510 | 2/1996 |

(Continued)

OTHER PUBLICATIONS

Extended European Search Report issued in related Patent Application No. EP-16195146, dated Mar. 9, 2017.

(Continued)

*Primary Examiner* — Daniel J Colilla

(74) *Attorney, Agent, or Firm* — ALG Intellectual Property, LLC

(57) ABSTRACT

A tape cartridge configured to be mounted on a tape printer having a print head. The tape cartridge includes a platen, a cartridge case, an insertion opening, and a platen bearing hole. The platen has a contact portion that contacts the print head with a print tape and an ink ribbon arranged therebetween. The cartridge case houses the print tape, the ink ribbon, and the platen. The insertion opening is formed in the cartridge case so that the print head may be inserted into the insertion opening. The platen bearing hole supports the platen rotatably.

4 Claims, 7 Drawing Sheets

(56) References Cited

U.S. PATENT DOCUMENTS

| | | | |
|---|---|---|---|
| 5,645,360 | A | 7/1997 | Iwane et al. |
| 5,702,192 | A | 12/1997 | Matsuhashi et al. |
| 5,853,254 | A | 12/1998 | Inakoshi et al. |
| 5,918,992 | A | 7/1999 | Matsuhashi et al. |
| 6,045,276 | A | 4/2000 | Matsuhashi et al. |
| 6,149,328 | A | 11/2000 | Matsuhashi et al. |
| 6,485,206 | B1 | 11/2002 | Takahashi |
| 2002/0094222 | A1 | 7/2002 | Furuya et al. |
| 2017/0087888 | A1* | 3/2017 | Nakajima ..... B41J 11/663 |

FOREIGN PATENT DOCUMENTS

| | | | |
|---|---|---|---|
| EP | 0696510 | A1 | 2/1996 |
| JP | 03-151261 | | 5/1991 |
| JP | 04-226375 | | 8/1992 |
| JP | 08-52913 | A | 2/1996 |
| JP | 2003-211750 | A | 7/2003 |
| JP | 2007-118507 | | 5/2004 |
| JP | 2005-231203 | | 9/2005 |
| JP | 2005-32956 | | 12/2005 |
| JP | 2005-329569 | | 12/2005 |
| JP | 2006-076103 | | 3/2006 |
| JP | 2009-214432 | | 9/2009 |
| JP | 2010-125728 | | 6/2010 |

OTHER PUBLICATIONS

Non-Final OA received in U.S. Appl. No. 13/808,800; dated May 1, 2014.

Final OA received in U.S. Appl. No. 13/808,800; dated Sep. 30, 2014.

Notice of Allowance received in U.S. Appl. No. 13/808,800; dated Jan. 23, 2015.

Non-Final OA received in U.S. Appl. No. 14/593,476; dated Sep. 8, 2015.

Notice of Allowance received in U.S. Appl. No. 14/593,476; dated Jan. 20, 2016.

* cited by examiner

[Fig. 1]
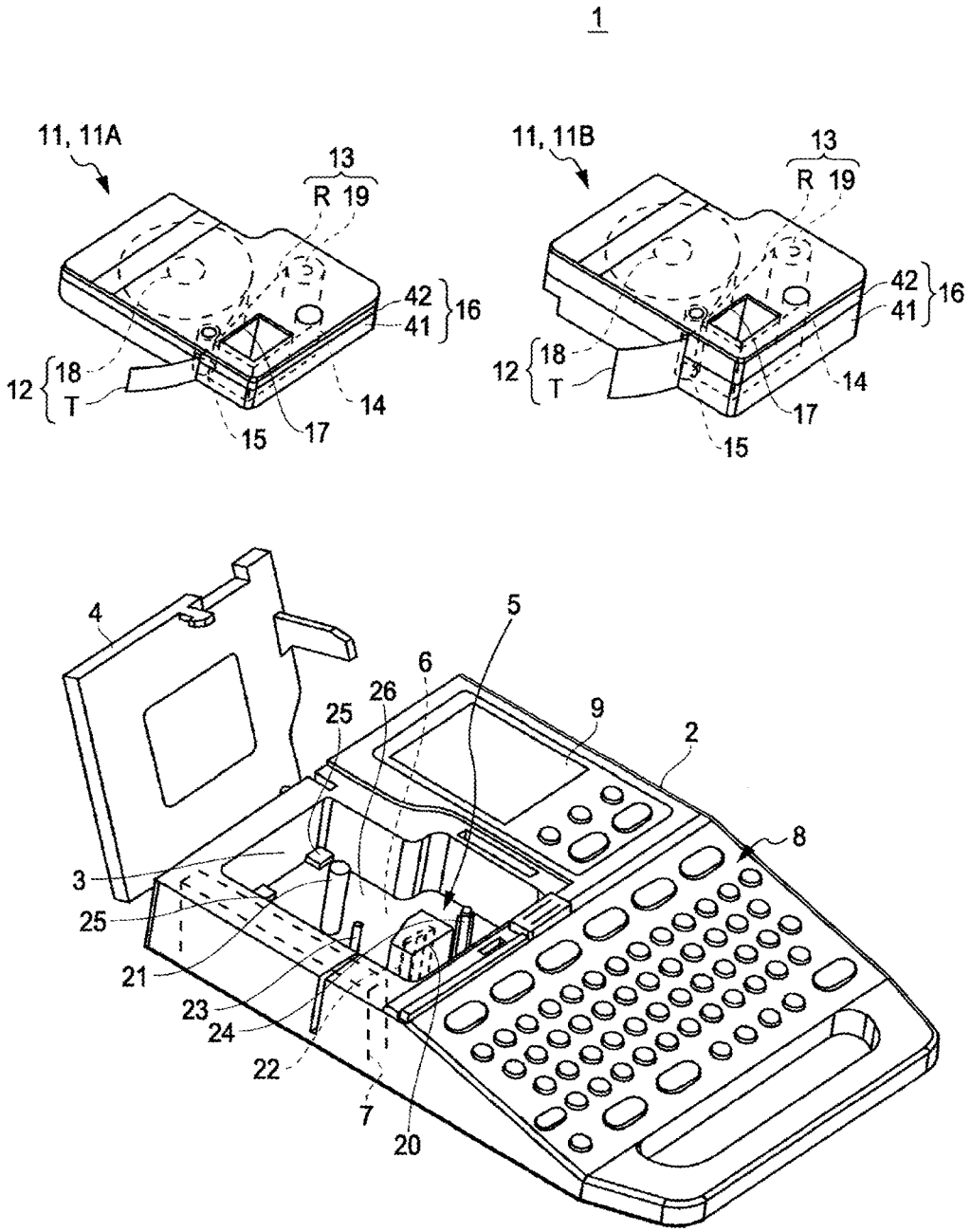

[Fig. 2A]
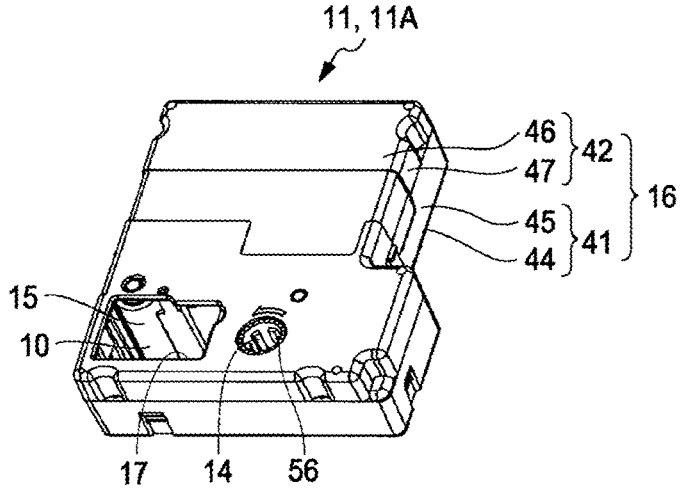
[Fig. 2B]
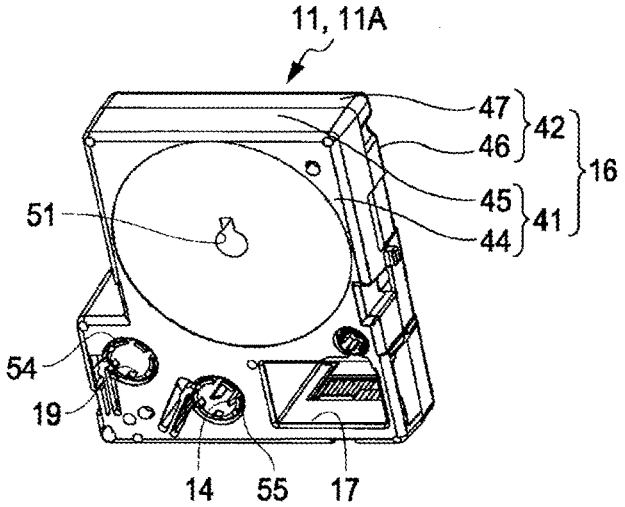
[Fig. 2C]
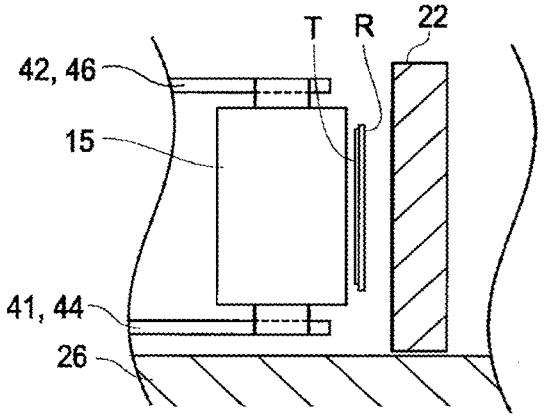

[Fig. 3A]
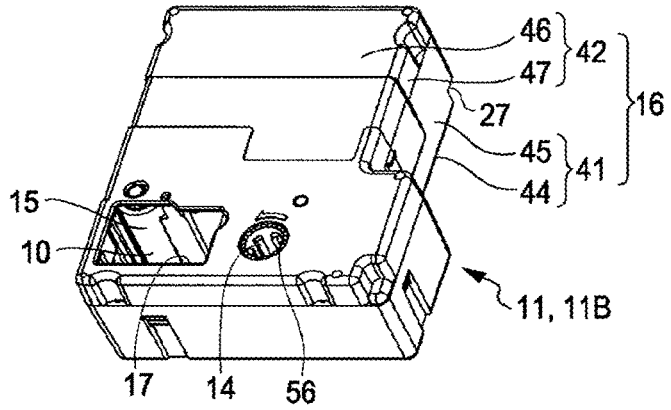
[Fig. 3B]
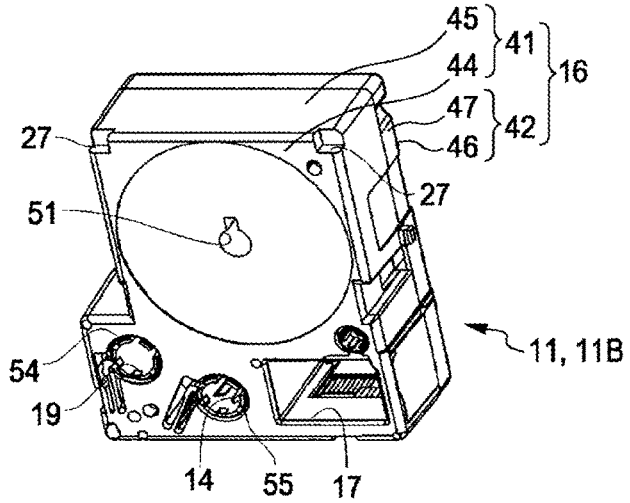
[Fig. 3C]
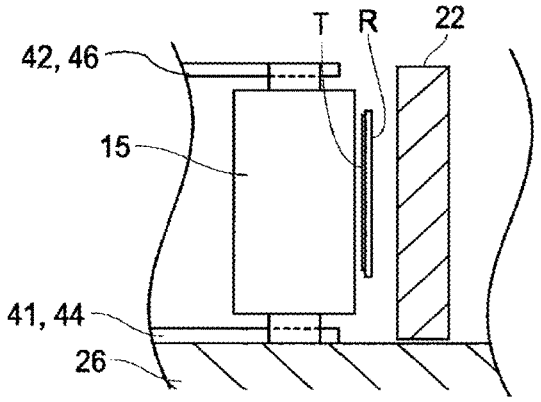

[Fig. 4]
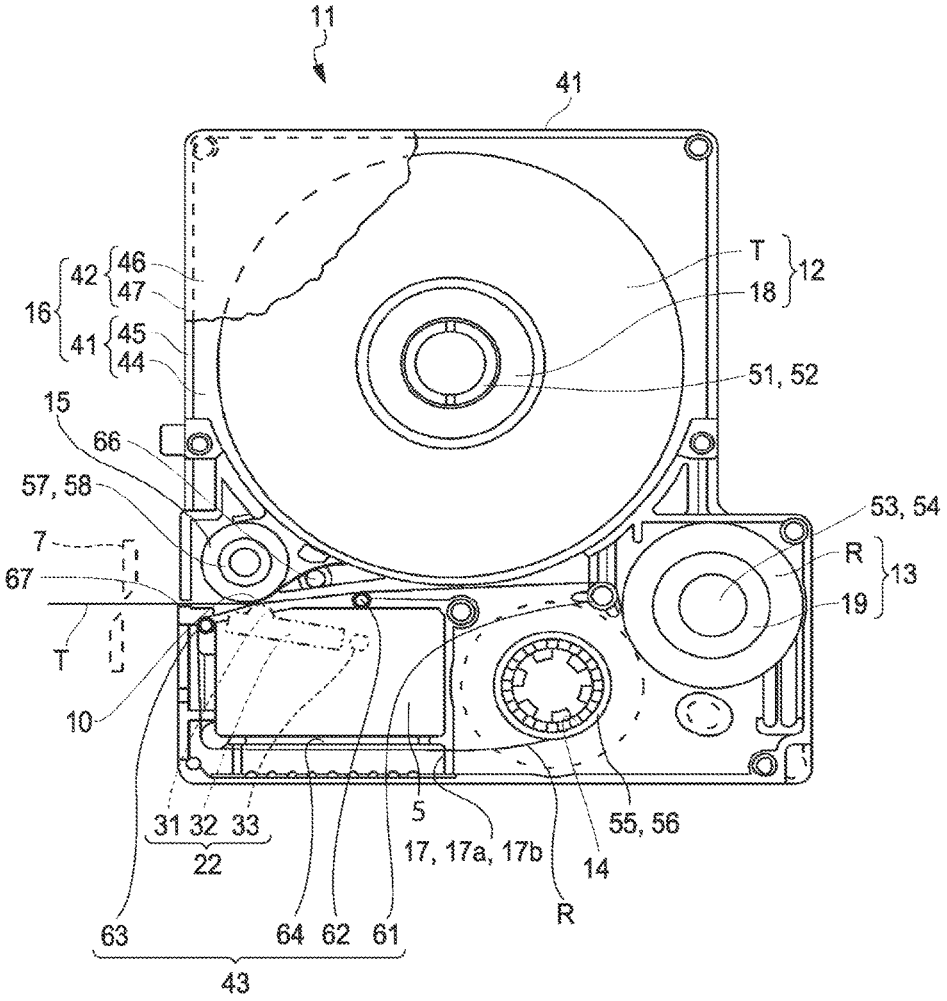

[Fig. 5A]
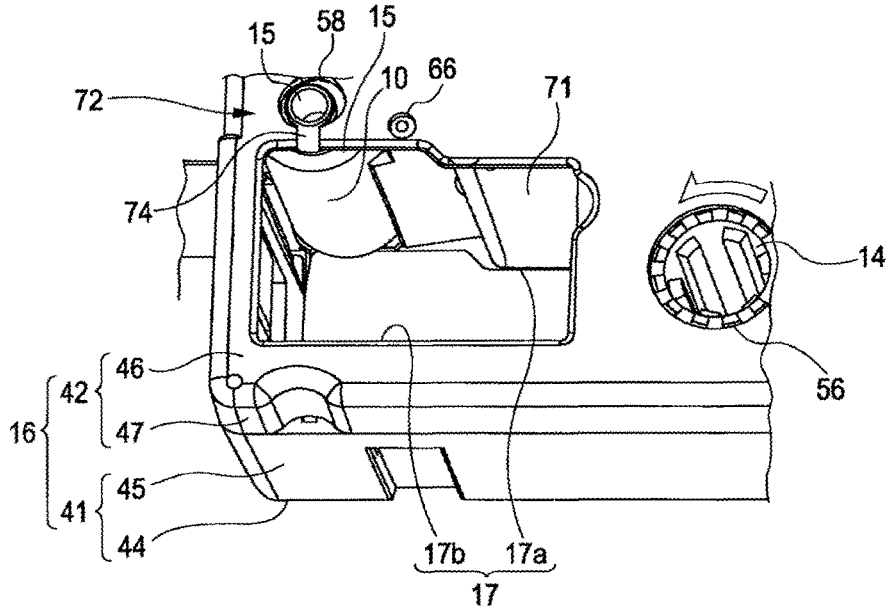
[Fig. 5B]
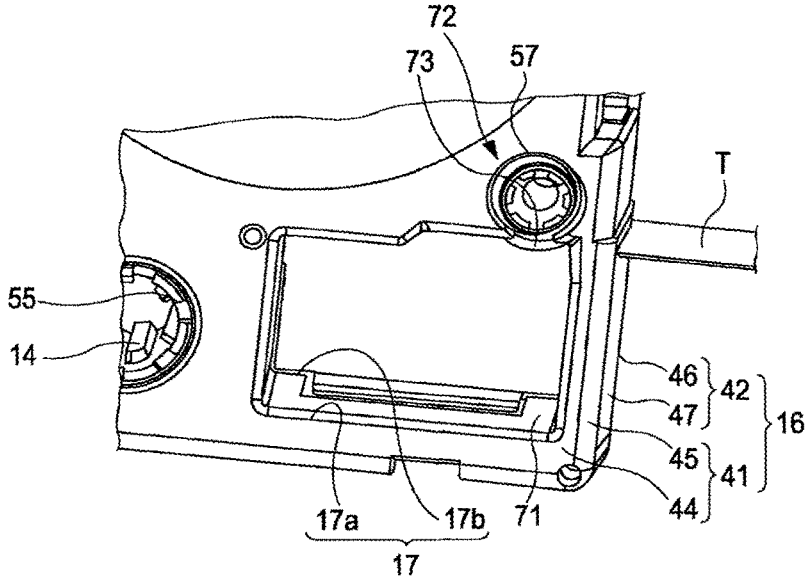

[Fig. 6]
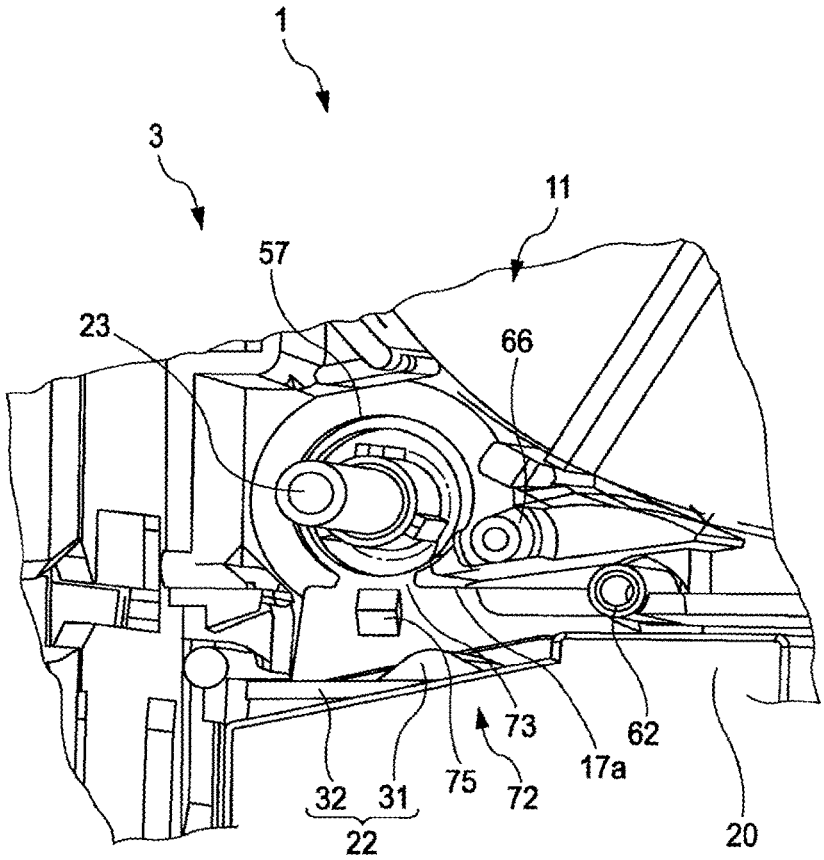

[Fig. 7]
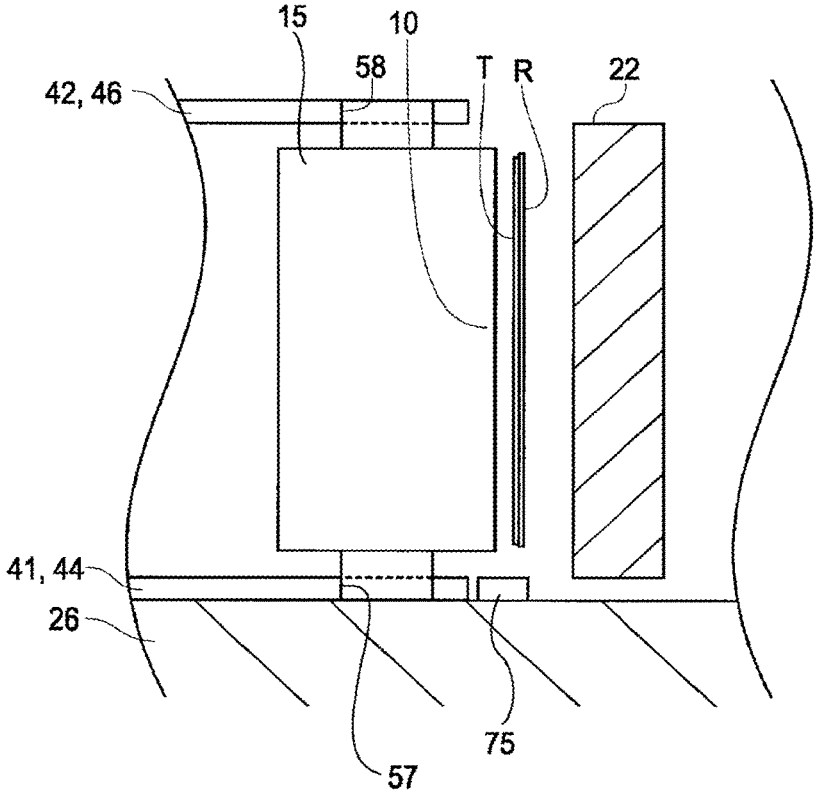

TAPE CARTRIDGE AND TAPE PRINTER

CROSS-REFERENCE TO RELATED APPLICATIONS

The present application is a continuation application of U.S. patent application Ser. No. 14/593,476 filed on Jan. 9, 2015, which is a continuation of U.S. patent application Ser. No. 13/808,800 filed on Jan. 7, 2013, which is the National Stage of International Application No. PCT/JP2011/003908 filed on Jul. 7, 2011, which claims priority from Japanese Patent Application No. 2010-161840 filed on Jul. 16, 2010, each of which are expressly incorporated by reference herein.

TECHNICAL FIELD

The present invention relates to a platen-mounted tape cartridge that is removably mounted on a tape printer, and also relates to the tape printer.

RELATED ART

As this type of tape cartridge, there is known a tape cartridge (see PTL 1) that is mounted on a tape printer such that a thermal head (print head) is inserted into a through opening (insertion opening) formed in a cartridge case. Then, the thermal head is pressed to a platen roller (platen) of the tape cartridge, so that the tape printer is brought into a print state.

This tape cartridge has an external shape that is defined by the cartridge case including an upper case and a seat-side lower case. The upper case has an upper through opening into which the thermal head is inserted. The lower case has a lower through opening into which the thermal head is inserted. The upper through opening is formed such that a contact portion of a platen roller that is brought into contact with the thermal head protrudes. The lower through opening is formed to extend by a certain length relative to the upper through opening such that the contact portion of the platen roller does not protrude. Accordingly, when the tape cartridge is mounted on the tape printer, an ink ribbon that is located near the platen roller is prevented from being hooked to another member.

In this tape printer with the tape cartridge mounted, seating of the tape cartridge is adjusted such that the thermal head (head body) and the platen roller (rubber roller) have equivalent heights and that a lower end portion of the thermal head does not interfere with an edge of the lower case defining the lower through opening.

CITATION LIST

Patent Literature

JP-A-2005-329569

SUMMARY OF INVENTION

Technical Problem

In a tape printer to which a thick tape cartridge (print tape with a large width) and a thin tape cartridge (print tape with a small width) can be mounted, a thermal head is provided to meet the thick tape cartridge. Owing to this, seating of the thin tape cartridge has to be adjusted on a lower-end basis to prevent an edge of a lower case from interfering with a lower end portion of the thermal head. Thus, the thermal head cannot contact (or cannot be pressed to) a platen roller (print tape) on a middle-position basis, and printing may not be properly performed.

Accordingly, an object of the invention is to provide a tape cartridge, seating of which does not have to be adjusted on a lower-end basis with respect to a print head, and to provide a tape printer.

Solution to Problem

According to an aspect of the invention, a tape cartridge includes a platen, when the tape cartridge is mounted on a tape printer, a print head of the tape printer contacting the platen with a print tape and an ink ribbon arranged therebetween such that the print head can be separated from the platen; a cartridge case that houses the print tape, the ink ribbon, and the platen; and an insertion opening formed in the cartridge case, the print head being inserted into the insertion opening. A contact portion of the platen that is brought into contact with the print head protrudes relative to a head receiver of the insertion opening to which the print head is exposed when the print head contacts the platen.

With this configuration, since the contact portion of the platen that is brought into contact with the print head protrudes relative to the head receiver of the insertion opening to which the print head is exposed, the print head that contacts the platen does not interfere with the head receiver. Accordingly, seating does not have to be adjusted on a lower-end basis with respect to the print head, and the platen and the print head can be mutually positioned on a middle-position basis. Thus, printing can be properly performed regardless of a head width or a tape width.

In this case, the cartridge case may preferably include a seat-surface-side first case wall, and a second case wall parallel to the first case wall. The platen may be rotatably supported from both sides by a first bearing hole that is formed in the first case wall and a second bearing hole that is formed in the second case wall. The head receiver may be defined by an edge of the first case wall near the insertion opening and an edge of the second case wall near the insertion opening, and have a first communication portion that communicates with the first bearing hole and a second communication portion that communicates with the second bearing hole.

With this configuration, even if the external shape of the platen is not increased in size, i.e., even if the platen that is rotatably supported by the first bearing hole formed in the first case wall and the second bearing hole formed in the second case wall has a small diameter, the print head that contacts the platen can be reliably prevented from interfering with the head receiver. Namely, the contact portion of the platen can sufficiently protrude relative to the head receiver of the insertion opening.

In this case, the head receiver may preferably have a shape that faces in a non-contact manner the print head being in contact with the platen.

With this configuration, not only a head body (heating elements) of the print head, but also a holder (hold member) that holds the head body can be prevented from interfering with the head receiver.

In this case, the cartridge case may further preferably include a feed guide that guides feed of the ink ribbon such that a feed path is exposed to an area near the contact portion.

With this configuration, even if the ink ribbon is loosened, since the ink ribbon is loosened toward the platen by pressure (contact) of the print head, the ink ribbon does not disturb mounting and removal of the tape cartridge to and from the tape printer.

According to another aspect of the invention, a tape printer can use several types of the above-described tape cartridges with different thicknesses. The tape printer includes a tape mount on which any of the tape cartridges can be removably mounted; the print head that protrudes from the tape mount and has a length corresponding to a distance between inner surfaces of the first and second case walls of the mounted tape cartridge with a maximum thickness; and a guide protrusion that protrudes from the tape mount, has a height corresponding to a thickness of the first case wall, is exposed to the first communication portion of the mounted tape cartridge, and guides rotation of the platen.

With this configuration, the platen and the print head can be mutually positioned on a middle-position basis regardless of the width of the print tape. Thus, print quality is not degraded. Also, even if a portion of the first bearing hole is partly cut by the first communication portion, rotation of the platen is not fluctuated due to the guide protrusion exposed to the first communication portion.

BRIEF DESCRIPTION OF DRAWINGS

FIG. 1 is an external perspective view of a tape printer according to a first embodiment when a lid is open.

FIG. 2A is a front-side perspective view of a standard cartridge.

FIG. 2B is a back-side perspective view of the standard cartridge.

FIG. 2C is a cross-sectional view schematically showing the positional relationship between a platen roller and a print head.

FIG. 3A is a front-side perspective view of a special cartridge.

FIG. 3B is a back-side perspective view of the special cartridge.

FIG. 3C is a cross-sectional view schematically showing the positional relationship between the platen roller and the print head.

FIG. 4 is a partial cut-away plan view of a tape cartridge.

FIG. 5A is a partly enlarged view of the periphery of an insertion opening.

FIG. 5B is a partly enlarged view of the periphery of an insertion opening.

FIG. 6 is a partly enlarged view of a tape printer according to a modification.

FIG. 7 is a cross-sectional view schematically showing the positional relationship between a platen roller and a print head according to the modification.

DESCRIPTION OF EMBODIMENT

A tape cartridge according to an embodiment of the invention and a tape printer on which the tape cartridge is mounted will be described below with reference to the accompanying drawings. This tape printer performs printing while a print tape and an ink ribbon are unwound from the mounted tape cartridge and cuts a printed portion of the print tape to create a label (tape piece).

As shown in FIG. 1, a tape printer 1 includes a housing 2 that defines an outer shell; a cartridge mount 3 (tape mount) that is depressed in an upper surface of the housing 2, a tape cartridge 11 that houses a print tape T etc. being removably mounted on the cartridge mount 3; an open/close lid 4 that opens and closes the cartridge mount 3; a print mechanism 5 that includes a print head 22 standing on the cartridge mount 3 and performs printing on the print tape T; a tape feed mechanism 6 that feeds the print tape T by unwinding the print tape T from the tape cartridge 11; a cut mechanism 7 that cuts the print tape T after printing; a keyboard 8 with which print information is input; and a display 9 that displays an input result. A user inputs print information with the keyboard 8 and then executes a print operation while the user checks the print information with the display 9.

The tape cartridge 11 includes a tape unit 12 in which the print tape T is wound around a tape core 18; a ribbon unit 13 in which an ink ribbon R is wound around a ribbon unwind core 19; a ribbon wind core 14 around which the used ink ribbon R is wound; a platen roller 15 (platen) that unwinds and feeds the print tape T from the tape unit 12; a cartridge case 16 that houses the tape unit 12, the ribbon unit 13, the ribbon wind core 14, and the platen roller 15; and an insertion opening 17 that is formed in the cartridge case 16, the print head 22 being inserted into the insertion opening 17 (the detail will be described later). For the tape cartridge 11, a thin standard cartridge 11A that houses a print tape T with a small tape width, and a thick special cartridge 11B that houses a print tape T with a large tape width are prepared (see FIG. 1).

The cartridge mount 3 has a shape substantially complementary to a shape of the tape cartridge 11, and includes on a bottom plate 26 a positioning protrusion 21 that positions the tape core 18, the print head 22 that is covered with a head cover 20, a platen driving shaft 23 that faces the print head 22 and drives to rotate the platen roller 15, and a ribbon wind driving shaft 24 that drives to wind the ink ribbon R through the ribbon wind core 14. Also, the cartridge mount 3 includes on the bottom plate 26 a plurality of bottom-raising protrusions 25 that raise the bottom of the tape cartridge 11 (standard cartridge 11A) in accordance with the thickness of the cartridge case 16, and a detector (not shown) that detects the type of the tape cartridge 11. Also, a tape feed mechanism 6 that is driven by a motor and rotates the platen driving shaft 23 and the ribbon wind driving shaft 24 is arranged below the bottom plate 26.

The print head 22 is a thermal head. The print head 22 includes a head body 31 with arrayed heating elements, a hold member 32 that holds the head body 31 at a distal end portion of the hold member 32, and a head support shaft 33 that rotatably supports the hold member 32 at a proximal end portion of the hold member 32 (see FIG. 4). Though not particularly illustrated, the hold member 32 engages with a head release mechanism. The head body 31 (print head 22) is brought into contact with or separated from the platen roller 15 in association with open/close operation of the open/close lid 4. Also, the hold member 32 swingably holds the head body 31 at a middle position in an up-down direction. When the head body 31 contacts (is pressed to) the platen roller 15, the head body 31 can be evenly pressed to the platen roller 15 in the array direction of the heating elements.

The plurality of bottom-raising protrusions 25 are arranged at both upper corners in plan view and a lower left corner in plan view of the cartridge mount 3. When the tape cartridge 11 of either type is mounted, the center in a height direction of the head body 31 (center of the heating element array) can be aligned with the center in a width direction of the print tape T (center in the up-down direction of the platen roller 15). As described above, the thin standard cartridge 11A and the thick special cartridge 11B are prepared for the tape cartridge 11. A seat surface of the standard cartridge 11A is defined by the plurality of bottom-raising protrusions 25. A seat surface of the special cartridge 11B is defined by the bottom plate 26. Hence, the special cartridge 11B has a plurality of recesses 27 (see FIG. 3B) to cancel the plurality of bottom-raising protrusions 25.

When the tape cartridge 11 is mounted on the cartridge mount 3, the tape core 18 engages with the positioning protrusion 21, the platen roller 15 engages with the platen driving shaft 23, and the ribbon wind core 14 engages with the ribbon wind driving shaft 24. When the open/close lid 4 is closed, the print head 22 contacts the platen roller 15 with the print tape T and the ink ribbon R arranged therebetween, and the tape printer 1 is brought into a print standby state. When printing is started, the ink ribbon R and the print tape T simultaneously run in a superposed manner The print tape T after desired printing by the print head 22 is sent to the outside of the tape cartridge 11 and the housing 2. The cut mechanism 7 cuts the printed portion. In contrast, the ink ribbon R used for printing is sent along a path in the tape cartridge 11, and is wound around the ribbon wind core 14 (the detail will be described later). After printing is completed, when the open/close lid 4 is opened, the print head 22 is turned and separated from the platen roller 15, and hence the tape cartridge 11 becomes removable.

Next, the tape cartridge 11 will be described below in more detail with reference to FIGS. 2A to 5B. As described above, the tape cartridge 11 has the tape unit 12, the ribbon unit 13, the ribbon wind core 14, and the platen roller 15 that are arranged in the cartridge case 16. Also, the tape cartridge 11 has the insertion opening 17 in the cartridge case 16 at a position near the platen roller 15.

The cartridge case 16 defines an outer shell of the tape cartridge 11. The cartridge case 16 includes a seat-side lower case 41, and an upper case 42 corresponding to the lower case 41. Also, the cartridge case 16 has therein a partition wall and a ribbon feed guide (feed guide) 43 that guides feed of the ink ribbon R. The lower case 41 has a seat-side lower case wall 44 (first case wall) and a lower peripheral wall 45 that stands on the lower case wall 44. The upper case 42 has an upper case wall 46 (second case wall) that is parallel to the lower case wall 44 and an upper peripheral wall 47 that stands on the upper case wall 46.

Referring to FIG. 2C, the cartridge case 16 of the standard cartridge 11A has a thickness such that the center in the width direction of the print tape T is aligned with the center in the height direction of the head body 31 when the standard cartridge 11A is seated on the plurality of bottom-raising protrusions 25, which serve as the seat surface. In contrast, as shown in FIGS. 3B and 3C, the cartridge case 16 of the thick special cartridge 11B has the plurality of recesses 27 in the lower case 41 to cancel the bottom-raising protrusions 25. When the special cartridge 11B is seated on the bottom plate 26, the center in the width direction of the print tape T is aligned with the center in the height direction of the head body 31. If three or more types of tape cartridges 11 with different thicknesses are prepared, the bottom-raising protrusions 25 are preferably formed stepwise. The recesses 27 preferably have shapes substantially complementary to shapes of the stepwise bottom-raising protrusions 25 (not shown).

Referring to FIG. 4, a lower tape bearing 51 and an upper tape bearing 52 that rotatably support the tape core 18 from both sides are respectively formed at substantially the centers in plan view of the lower case wall 44 and the upper case wall 46. A lower core bearing 53 and an upper core bearing 54 that support the ribbon unwind core 19 from both sides are respectively formed at right end portions in plan view of the lower case wall 44 and the upper case wall 46. Also, a lower insertion opening 17*a* and an upper insertion opening 17*b* that define the insertion opening 17 and into which the print head 22 is inserted are respectively formed in left end portions in plan view of the lower case wall 44 and the upper case wall 46. A lower wind bearing hole 55 and an upper wind bearing hole 56 that support the ribbon wind core 14 from both sides are formed at the right side in plan view of the insertion opening 17. Also, a lower platen bearing hole 57 (first bearing hole) and an upper platen bearing hole 58 (second bearing hole) that rotatably support the platen roller 15 from both sides are formed at the upper side in plan view of the insertion opening 17. Further, the ribbon feed guide 43 that guides feed of the ink ribbon R, and a tape guide pin 66 that guides feed of the print tape T are formed in the periphery of the insertion opening 17.

The ribbon feed guide 43 defines a feed path of the ink ribbon R. The ribbon feed guide 43 includes a first ribbon pin 61, a second ribbon pin 62, a third ribbon pin 63, and a peripheral wall guide 64 of the insertion opening 17 that are arranged from an unwind side to a wind side of the ink ribbon R. The second ribbon pin 62 and the third ribbon pin 63 are arranged such that the feed path of the ink ribbon R is exposed to an area near the platen roller 15, and more particularly to an area near a contact portion 10 of the platen roller 15 that is brought into contact with the print head 22. Accordingly, the exposed portion of the ink ribbon R that is brought into contact with the print head 22 faces the contact portion 10 of the platen roller 15 with a very small gap arranged therebetween.

The print tape T unwound from the tape core 18 is guided by the tape guide pin 66 to the contact portion 10 of the platen roller 15, and is used for printing at this portion. After printing, the print tape T is sent out from a tape output port 67 that is formed in the cartridge case 16. In contrast, the ink ribbon R unwound from the ribbon unwind core 19 is guided by the first ribbon pin 61 and the second ribbon pin 62 to the contact portion 10 of the platen roller 15, and is used for printing at this portion while the ink ribbon R is superposed on the print tape T. Then, the ink ribbon R passes the third ribbon pin 63 and the peripheral wall guide 64 (so as to extend around the insertion opening 17), and is wound around the ribbon wind core 14. That is, the ink ribbon R is pressed to the platen roller 15 by the pressure (contact) of the print head 22 at the exposed portion between the second ribbon pin 62 and the third ribbon pin 63 even if the ink ribbon R is loosened. Hence, the ink ribbon R does not disturb mounting and removal of the tape cartridge 11 to and from the tape printer 1.

Next, the periphery of the insertion opening 17 will be described in detail with reference to FIGS. 5A and 5B. As described above, the insertion opening 17 into which the print head 22 is inserted is formed at the left end portion in plan view of the cartridge case 16, and the platen roller 15 is rotatably supported at the upper side in plan view of the insertion opening 17.

The insertion opening 17 is defined by the lower insertion opening 17*a* of the lower case wall 44, the upper insertion opening 17*b* of the upper case wall 46, and an inner peripheral wall portion 71 (portion of the lower case 41). The inner peripheral wall portion 71 is not formed at a head receiver 72 from which the print head 22 is exposed. The head receiver 72 of the insertion opening 17 is formed by the lower insertion opening 17*a* and the upper insertion opening 17*b*.

In particular, the head receiver 72 is defined by an edge of the lower insertion opening 17*a* near the platen roller 15 and an edge of the upper insertion opening 17*b* near the platen roller 15. The edge of the lower insertion opening 17*a* and the edge of the upper insertion opening 17*b* are formed by cutting such that the contact portion 10 of the platen roller 15 protrudes. To be more specific, the edge of the lower insertion opening 17*a* that defines the head receiver 72 has a lower communication portion 73 that communicates with the lower platen bearing hole 57, and the edge of the upper insertion opening 17*b* has an upper communication portion 74 that communicates with the upper platen bearing hole 58. These edges face in a non-contact manner the print head 22 being in contact with the platen roller 15.

The lower communication portion 73 has a depressed shape such that the edge of the lower insertion opening 17*a* and the lower platen bearing hole 57 communicate with each other. To be more specific, the lower communication portion 73 is formed at a position corresponding to a region defined by connecting the rotation shaft of the platen roller 15 and the contact portion 10 such that the platen roller 15 is not detached from the lower platen bearing hole 57. Similarly, the upper communication portion 74 causes the edge of the upper insertion opening 17*b* and the upper platen bearing hole 58 to communicate with each other, and is formed at a position corresponding to the region defined by connecting the rotation shaft of the platen roller 15 and the contact portion 10 such that the platen roller 15 is not detached from the upper platen bearing hole 58. Accordingly, even if the platen roller 15 has a small diameter, the print head 22 (in this case, the head body 31 and a portion of the hold member 32) that contacts the platen roller 15 can be reliably prevented from interfering with the head receiver 72.

With the above configuration, since the contact portion 10 of the platen roller 15 protrudes relative to the head receiver 72, the print head 22 does not interfere with the head receiver 72. Accordingly, the platen roller 15 and the print head 22 can be mutually positioned on a middle-position basis. Also, since the print head 22 with a sufficient length (in the height direction) can be formed, a pattern, a background, or the like, can be printed on the entire surface.

Next, a tape printer 1 according to a modification of the invention will be described with reference to FIGS. 6 and 7. To omit redundant description, a configuration different from that of the first embodiment is mainly described. The cartridge mount 3 of the tape printer 1 has a guide protrusion 75 that guides rotation of the platen roller 15. The guide protrusion 75 is arranged near the platen driving shaft 23 so as to face the lower communication portion 73 of the mounted tape cartridge 11. The guide protrusion 75 has a height corresponding to the thickness of the lower case wall 44.

The print head 22 has a length corresponding to the distance between the inner surfaces of the lower case wall 44 and the upper case wall 46 in the tape cartridge 11 with the maximum thickness that can be mounted (in this specification, the special cartridge 11B). Accordingly, even if a portion of the lower platen bearing hole 57 is partly cut due to the lower communication portion 73, the rotation of the platen roller 15 is not fluctuated.

In this embodiment, the head receiver 72 is defined by the lower communication portion 73 that causes the edge of the lower insertion opening 17*a* and the lower platen bearing hole 57 to communicate with each other and the upper communication portion 74 that causes the edge of the upper insertion opening 17*b* and the upper platen bearing hole 58 to communicate with each other. However, as long as the contact portion 10 of the platen roller 15 protrudes relative to the edge of the lower insertion opening 17*a* and the edge of the upper insertion opening 17*b*, the head receiver 72 may reach to positions near the lower platen bearing hole 57 and the upper platen bearing hole 58. That is, the head receiver 72 may not communicate with the lower platen bearing hole 57 or the upper platen bearing hole 58 and a thin wall may be formed.

What is claimed is:

1. A tape cartridge that is configured to be mounted on a tape printer having a print head, the tape cartridge comprising:

a platen having a contact portion that contacts the print head with a print tape and an ink ribbon arranged therebetween;

a cartridge case that houses the print tape, the ink ribbon, and the platen;

an insertion opening formed in the cartridge case, the print head being inserted into the insertion opening; and a platen bearing hole that supports the platen rotatably, wherein an edge of the insertion opening has a communication portion that communicates with the platen bearing hole, and the communication portion is formed at a position corresponding to a region defined by connecting a rotation shaft of the platen and the contact portion of the platen such that the platen is not detached from the platen bearing hole.

2. The tape cartridge according to claim 1, wherein the cartridge case includes a first case and a second case;

the first case has a first insertion opening that configures the insertion opening;

the second case has a second insertion opening that configures the insertion opening; and an edge of the first insertion opening and an edge of the second insertion opening are formed by cutting such that the contact portion of the platen protrudes.

3. The tape cartridge according to claim 2, wherein the edge of the first insertion opening has a first communication portion that communicates with the platen bearing hole; and the first communication portion has a depressed shape.

4. The tape cartridge according to claim 1, wherein the platen is a roller.

* * * * *